US011365565B2

(12) United States Patent
Nam et al.

(10) Patent No.: US 11,365,565 B2
(45) Date of Patent: Jun. 21, 2022

(54) MOTOR-DRIVEN DOOR LATCH FOR VEHICLE

(71) Applicants: Hyundai Motor Company, Seoul (KR); Kia Motors Corporation, Seoul (KR)

(72) Inventors: Jinwoo Nam, Seoul (KR); Kyoung Taek Kwak, Yongin-si (KR); Jungho Han, Seoul (KR)

(73) Assignees: Hyundai Motor Company, Seoul (KR); Kia Motors Cornoration, Seoul (KR)

( * ) Notice: Subject to any disclaimer, the term of this patent is extended or adjusted under 35 U.S.C. 154(b) by 415 days.

(21) Appl. No.: 16/445,919

(22) Filed: Jun. 19, 2019

(65) Prior Publication Data

US 2020/0263455 A1 Aug. 20, 2020

(30) Foreign Application Priority Data

Feb. 19, 2019 (KR) ..... 10-2019-0019248

(51) Int. Cl.

| | |
|---|---|
| ***E05B 77/04*** | (2014.01) |
| ***E05B 81/06*** | (2014.01) |
| ***E05B 81/36*** | (2014.01) |
| ***E05B 81/30*** | (2014.01) |
| ***E05B 81/16*** | (2014.01) |

(52) U.S. Cl.

CPC ..... *E05B 77/04* (2013.01); *E05B 81/06* (2013.01); *E05B 81/16* (2013.01); *E05B 81/30* (2013.01); *E05B 81/36* (2013.01)

(58) Field of Classification Search

CPC ..... E05B 77/04; E05B 77/12; E05B 77/06; E05B 81/06; E05B 81/30; E05B 81/36

See application file for complete search history.

(56) References Cited

U.S. PATENT DOCUMENTS

| | | | | |
|---|---|---|---|---|
| 10,392,838 | B2 * | 8/2019 | Tomaszewski | E05B 81/77 |
| 2017/0342748 | A1 * | 11/2017 | Debroucke | E05B 77/06 |
| 2018/0023325 | A1 * | 1/2018 | Takagi | E05B 81/64 292/259 A |
| 2019/0301212 | A1 * | 10/2019 | Digel | E05B 81/36 |
| 2020/0190861 | A1 * | 6/2020 | Margheritti | E05B 81/14 |

FOREIGN PATENT DOCUMENTS

| | | | | |
|---|---|---|---|---|
| CN | 110318609 A | * | 10/2019 | E05B 81/16 |
| KR | 20160148819 A | * | 12/2016 | |

* cited by examiner

*Primary Examiner* — Kristina R Fulton
*Assistant Examiner* — James Edward Ignaczewski
(74) *Attorney, Agent, or Firm* — Slater Matsil, LLP

(57) ABSTRACT

A motor-driven door latch for a vehicle includes a catch part which is caught on a striker mounted on the vehicle to lock a vehicle door to a vehicle body or is released from the striker so that the door can be opened from the vehicle body. A door locking and releasing part includes a main motor and applies torque to the catch part through the main motor to allow the catch part to be locked to or released from the striker. A collision response part applies torque to the catch part through the door locking and releasing part in order to keep the door in the collision in the locked state and allow the door on the side opposite to the collision to be opened in the event of a collision.

20 Claims, 12 Drawing Sheets

MOTOR-DRIVEN DOOR LATCH FOR VEHICLE

CROSS-REFERENCE TO RELATED APPLICATIONS

This application claims priority to Korean Patent Application No. 10-2019-0319248, filed in the Korean Intellectual Property Office on Feb. 19, 2019, which application is hereby incorporated herein by reference.

TECHNICAL FIELD

The present invention relates to a motor-driven door latch for a vehicle.

BACKGROUND

Generally, a motor-driven door latch for a vehicle is used to lock or unlock a door to a vehicle body by using a motor for the convenience of the user.

In addition, an inside handle and an outside handle are respectively installed to allow the user to grasp the vehicle door and to easily operate the vehicle door, and a switch or the like is provided on the vehicle door for locking or releasing the motor-driven door latch.

However, in the conventional motor-driven door latch structure, when vehicle collision occurs, the door in the collision should remain locked state but a door locking mechanism for preparing collision is installed on a door outside panel, so that it is not possible to maintain its original functions due to damage of the door outside panel, thereby threatening the safety of passengers.

The above information disclosed in this Background section is only for enhancement of understanding of the background of the invention and therefore it may contain information that does not form the prior art that is already known in this country to a person of ordinary skill in the art.

SUMMARY

The present invention relates to a motor-driven door latch for a vehicle. Particular embodiments of the present invention relate to a motor-driven door latch for a vehicle that maintains a locking state of the door in the collision and allows the door on the opposite side of the collision to be opened, thereby improving safety of passengers on collision.

Embodiments of the present invention can provide a motor-driven door latch for a vehicle that maintains a locking state of the door in the collision and allows the door on the opposite side of the collision to be opened when vehicle collision occurs, thereby improving collision safety.

A motor-driven door latch for a vehicle according to an exemplary embodiment of the present invention may include a catch part, which is caught on a striker mounted on the vehicle to lock a door for a vehicle to a vehicle body or is released from the striker so that the door can be opened from the vehicle body. A door locking and releasing part includes a motor and applies torque to the catch part through the motor to allow the catch part to be locked to or released from the striker. A collision response part applies torque to the catch part through the door locking and releasing part in order to keep the door in the collision in the locked state and allow the door on the side opposite to the collision to be opened in the event of a collision.

An inside emergency operating lever, which is connected with an inside handle installed at the door for the vehicle and receives an operation force of the inside handle to rotate and applies torque to the catch part through the collision response part and the door locking and releasing part, may be further included.

An outside emergency operating lever, which is connected with an outside handle installed at the door for the vehicle and receives an operation force of the outside handle to rotate and applies torque to the catch part through the collision response part and the door locking and releasing part, may be further included.

The catch part may comprise a catch having a locking groove which the striker mounted on the vehicle body is catch in or separated from and being installed to be rotatable; and a pawl installed to be rotatable and in close contact with the catch to limit the rotation of the catch or separated from the catch to allow the catch to be freely rotatable.

The door locking and releasing part may comprise the motor, which can rotates in a clockwise and anticlockwise directions and includes a drive gear; a driven gear engaged with the drive gear; a pawl release lever coupled to the pawl to be integrally rotated; and an operating lever, which is engaged with the driven gear and receives the torque through the driven gear to rotate the pawl release lever.

The collision response part may comprise a master locking link, which is installed to be rotatable and includes a hook at one end portion thereof; a control lever, which is installed to be rotatable, and includes an inertia weight at one end portion thereof and arm at the other end portion thereof, so that the arm is connected at or separated from the master locking link to control the operation of the master locking link; and a pressurizing spring applying an elastic force to the master locking link in order to rotate the master locking link in a direction.

Two seating protrusions may be formed at the pawl release lever; and a pressurizing protrusion which seats on the seating protrusions, and presses and rotates the pawl release lever, may be provided at the operating lever.

A door latch controller detecting an operation of a handle or a button installed at the door for the vehicle and applying an operation signal to the motor, may be further included.

The inside emergency operating lever may be installed to be rotatable and one end portion thereof is provided with a pressurizing flange; and the master locking link may be provided with a rotation inducing flange, which corresponds to the pressurizing flange and is pressed by the pressurizing flange down to rotate the master locking link.

The outside emergency operating lever may be installed to be rotatable, one end portion thereof may be formed with a wire hole with which a wire is connected and the other end portion thereof is formed with a first long hole; and the master locking link may be provided with a pin shaft inserted into the first long hole.

A key cylinder into which a key for a vehicle is inserted to operate may be provided with a key nut. The key nut may be connected with one end portion of a key lever. The other end portion of the key lever may be connected with the control lever.

The key lever may be formed with a second long hole at a lower portion thereof; and the control lever may be provided with a coupling protrusion inserted into the second long hole.

A protrusion may be provided at an upper portion of the key lever. The key nut may be provided with two first and second operating protrusions spaced from each other in a circumference direction. A movable groove into which the protrusion is inserted to move may be provided between the first and second operating protrusions.

In accordance with the motor-driven door latch for a vehicle according to an exemplary embodiment of the present invention, since a door for a vehicle can be locked a vehicle body in a stable manner by using a main motor and the locked door can be freely released from the vehicle body, the user can conveniently use the door for the vehicle.

Further, when vehicle collision occurs, the door in the collision maintains a locking state and the door on the opposite side of the collision can be opened, thereby improving collision safety.

In addition, when the motor is inoperable, a key for the vehicle can be used to release the door locked to the vehicle body, thereby improving the use convenience of the door for a vehicle.

BRIEF DESCRIPTION OF THE DRAWINGS

These drawings are for reference purposes only and are not to be construed as limiting the technical idea of the present invention to the accompanying drawings.

Figure 1:
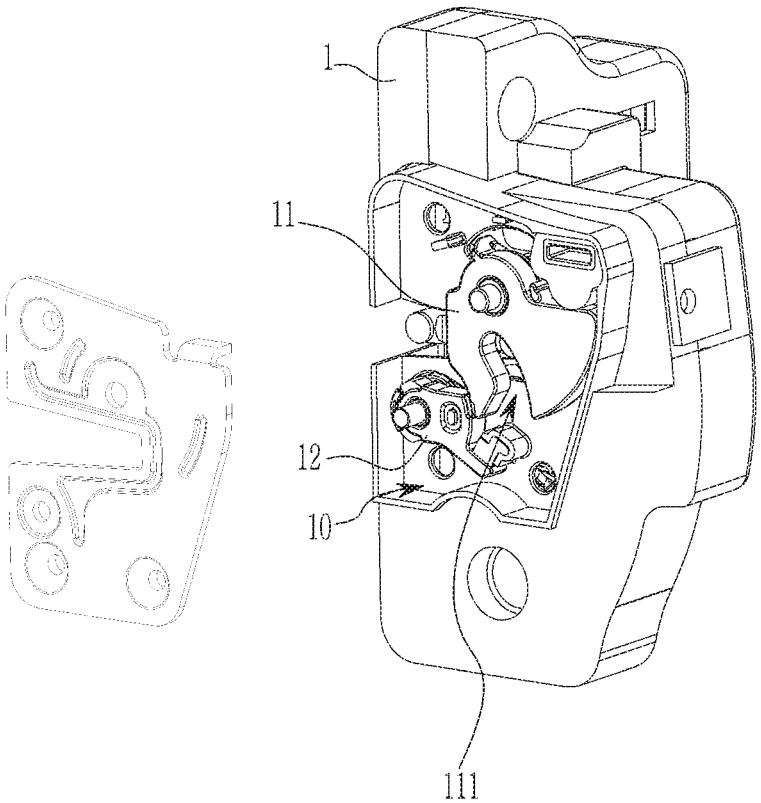
FIG. 1 is a side view of a motor-driven door latch for a vehicle according to an exemplary embodiment of the present invention.
Figure 2:
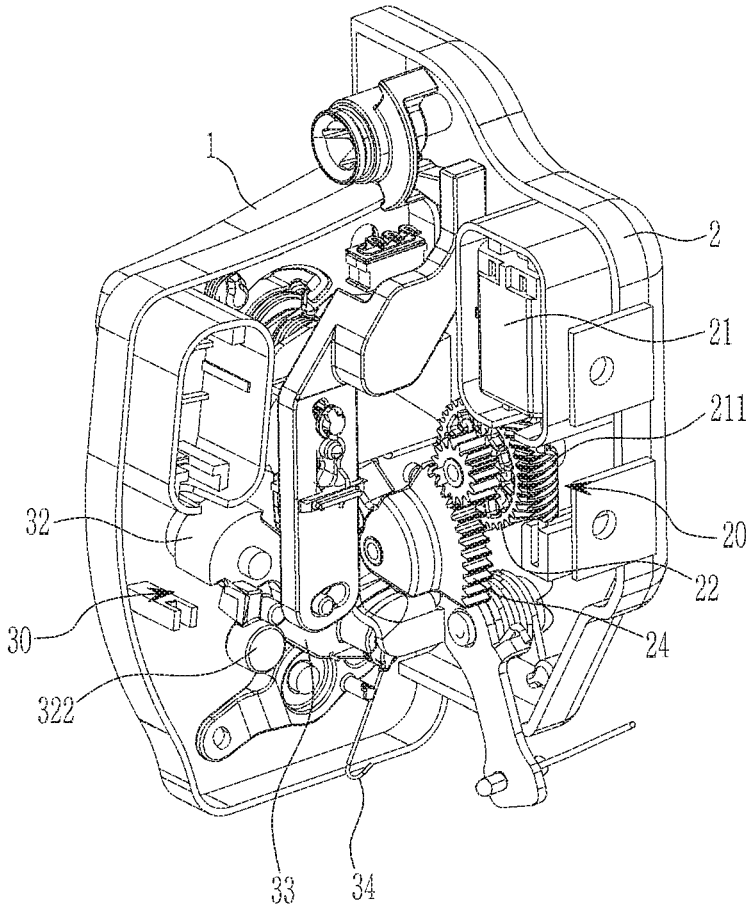
FIG. 2 is a front view of the motor-driven door latch for the vehicle according to an exemplary embodiment of the present invention.
Figure 3:
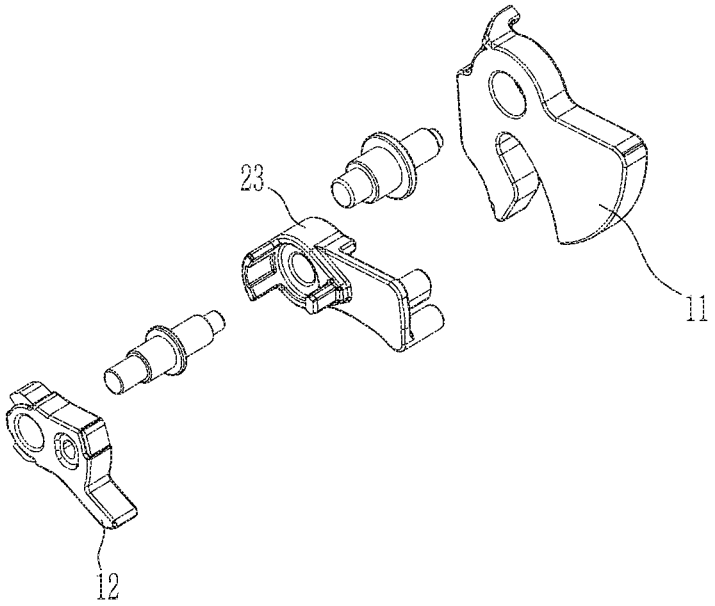
FIG. 3 is an exploded perspective view of a catch part of the motor-driven door latch for the vehicle according to an exemplary embodiment of the present invention.
Figure 4:
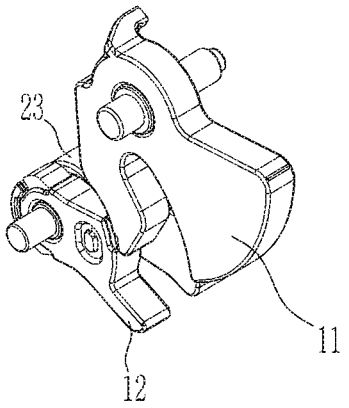
FIG. 4 is a perspective view showing coupling state of a pawl and a pawl release lever of the motor-driven door latch for the vehicle according to an exemplary embodiment of the present invention.
Figure 5:
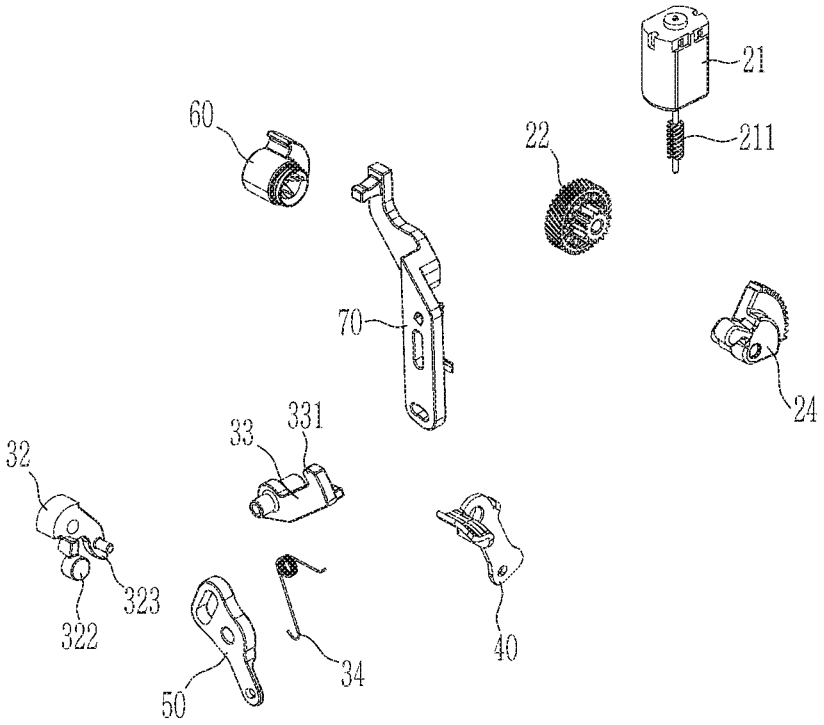
FIG. 5 is an exploded perspective view of a door locking and releasing part and a collision response part of the motor-driven door latch for the vehicle according to an exemplary embodiment of the present invention.

The following reference numerals can be used in conjunction with the drawings:

1: first base plate
2: second base plate
10: catch part
11: catch
12: pawl
20: door locking and releasing part
21: main motor
22: driven gear
23: pawl release lever
24: operating lever
30: collision response part
32: control lever
33: master locking link
34: pressurizing spring
40: inside emergency operating lever
50: outside emergency operating lever
60: key nut
70: key lever

DETAILED DESCRIPTION OF ILLUSTRATIVE EMBODIMENTS

The present invention will be described more fully hereinafter with reference to the accompanying drawings, in which exemplary embodiments of the invention are shown.

As those skilled in the art would realize, the described embodiments may be modified in various different ways, all without departing from the spirit or scope of the present invention.

The drawings and description are to be regarded as illustrative in nature and not restrictive. Like reference numerals designate like elements throughout the specification.

Since size and thickness of each component illustrated in the drawings are arbitrarily represented for convenience in explanation, the present invention is not particularly limited to the illustrated size and thickness of each component and the thickness is enlarged and illustrated in order to clearly express various parts and areas.

In the following description, dividing names of components into first, second and the like is to divide the names because the names of the components are the same as each other and an order thereof is not particularly limited.

Throughout the specification, unless explicitly described to the contrary, the word "comprise" and variations such as "comprises" or "comprising" will be understood to imply the inclusion of stated elements but not the exclusion of any other elements.

Referring FIGS. 1 to 5, a motor-driven door latch for a vehicle according to an exemplary embodiment of the present invention may include a catch part 10 which is caught on a striker mounted on the vehicle to lock a door for a vehicle to the vehicle body or is released from the striker so that the door can be opened from the vehicle body; a door locking and releasing part 20 which applies torque to the catch part 10 to allow the catch part 10 to be locked to or released from the striker; and a collision response part 30 that applies torque to the catch part 10 through the door locking and releasing part 20 in order to keep the door in the collision in the locked state and allow the door on the side opposite to the collision to be opened in the event of a collision.

The catch part 10 may include a catch 11, which is rotatably mounted on one side of a first base plate 1 and has a locking groove in which the striker mounted on the vehicle body is inserted into or separated from and a pawl 12, which is mounted on the first base plate 1 to be rotatable and is in close contact with the catch 11 to limit the rotation of the catch 11 or separated from the catch 11 to allow the catch 11 to be freely rotatable.

The door locking and releasing part 20 may include a motor 21, which is mounted on a second base plate 2, rotatable in a clockwise and anticlockwise directions, and includes a first drive gear 211; a first driven gear 22 engaged with the first drive gear 211; a pawl release lever 23 which is disposed with the first base plate 1 interposed therebetween and coupled to the pawl 12 to be integrally rotated (referring to FIG. 4); and an operating lever 24, which is engaged with the first driven gear 22 and rotates while receiving a torque from the first driven gear 22 to rotate the pawl release lever 23.

The collision response part 30 may include a master locking link 33 of which one end portion is rotatably mounted on the first base plate 1 and the other end portion is provided with a hook 331; a control lever 32 rotatably mounted on the first base plate 1, provided with an inertia weight 322 at one end portion thereof, an arm 323 at the other end portion thereof, the arm 323 being contacted at or separated from the master locking link 33 to control the operation of the master locking link 33; and a pressurizing spring 34 for pressurizing the master locking link 33 to be rotated in a clockwise direction.

Therefore, when the user operates a release handle or a button mounted on the door, a door latch controller detects this to apply an operation signal to the motor 21 to operate the motor 21.

Figure 6:
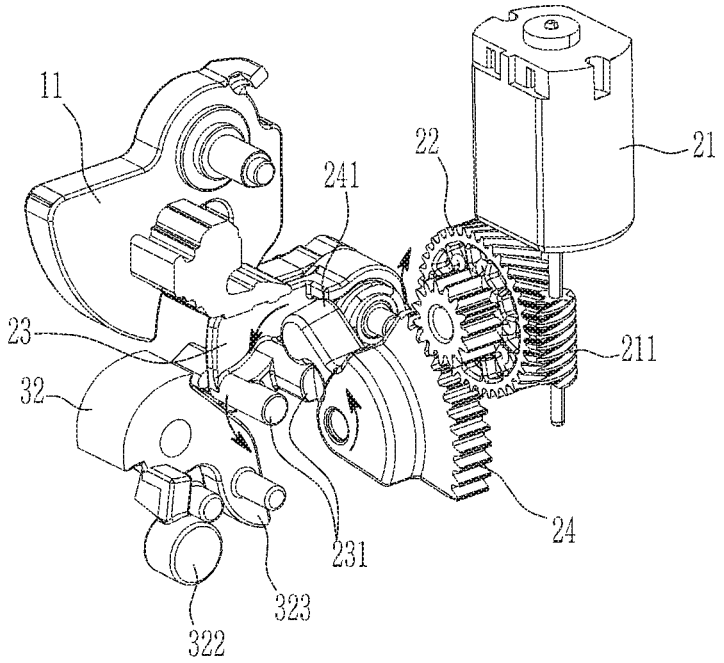
FIG. 6 is an operational explanatory diagram of the door locking and releasing part of the motor-driven door latch for the vehicle according to an exemplary embodiment of the present invention.

Referring to FIG. 6, the drive gear 211 and the driven gear 22 rotate respectively by driving the motor 21, the operating lever 24 engaged with the driven gear 22 is rotated to press and rotate the pawl release lever 23, and the pawl 12 rotates together by the rotation of the pawl release lever 23 and is spaced from the catch 111, so that the catch 11 can freely rotate, whereby the door locked the vehicle body is released and the door can be opened.

Therefore, when the user pushes or pulls the door while holding the inside handle or the outside handle installed on the door, the door is opened while one side of the door is supported by the vehicle body and the door is being rotated.

The pawl release lever 23 may be provided with two seating protrusions 231 and the operating lever 24 may be provided with a pressurizing protrusion 241 which is seated on the seating protrusions 231 to press and rotate the pawl release lever 23.

Figure 7:
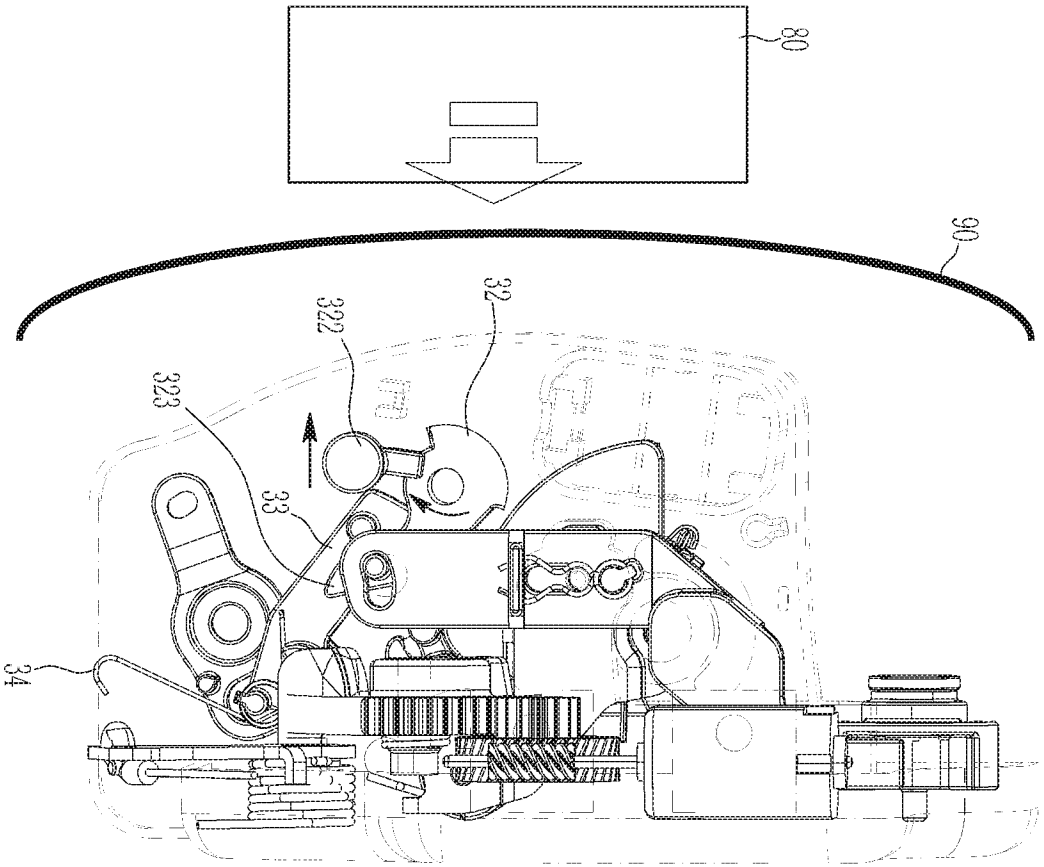
FIGS. 7 and 8 are operational explanatory diagrams of the motor-driven door latch for the vehicle according to an exemplary embodiment of the present invention in the event of a collision.

Referring to FIG. 7, in the event of a collision when doors for the vehicle locked, If an outer impactor 80 hits an outside panel 90 of the door in the collision, the inertia weight 322 of the control lever 32 is subjected to inertia in the opposite direction to the collision direction, which causes the control lever 32 to rotate clockwise.

As the control lever 32 rotates, the arm 323 of the control lever 32 is contacted with the master locking link 33 to suppress the master locking link 33 from rotating in anticlockwise direction, so that the locked state of the door in the collision is maintained.

Figure 8:
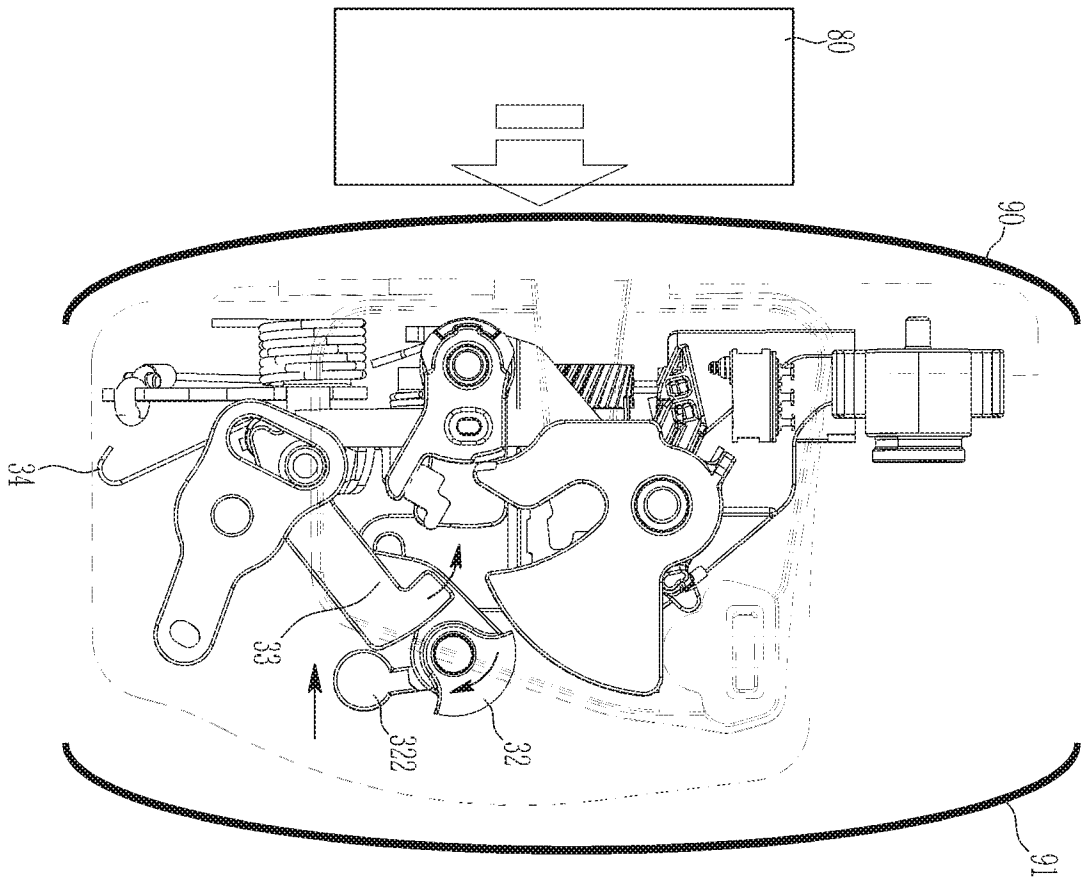

Referring to FIG. 8, in the door on the side opposite to the collision, the inertia weight 322 of the control lever 32 is inertially rotated in an opposite direction to the collision direction and rotated clockwise, which causes the control lever 32 to be separated from the master locking link 33, so that the master locking link 33 receives the elastic force of the pressurizing spring 34 to rotate in an anticlockwise direction and the hook 331 of the master locking link 33 is hung on the seating protrusions 231 of the pawl release lever 23 to achieve a door lock release preparation state.

In the door lock release preparation state, if a passenger pulls the inside handle, an inside emergency operating lever 40 connected with the inside handle through a wire 41 is rotated.

Figure 9:
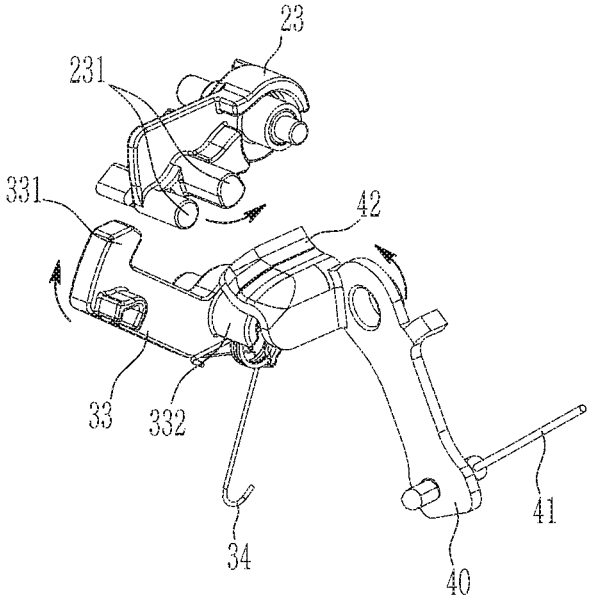
FIG. 9 is an operational explanatory diagram of an inside emergency operating lever and a master locking link of the motor-driven door latch for the vehicle according to an exemplary embodiment of the present invention.

The inside emergency operating lever 40 may be installed on the second base plate 2 to be rotatable and one end portion thereof may be provided with a pressurizing flange 42, as shown in FIG. 9.

Further, in the master locking link 33, a rotation inducing flange 332 may be formed in a circular arc shape corresponding to the pressurizing flange 42. The pressurizing flange 42 is integrally rotated by the rotation of the inside emergency operating lever 40 to press the rotation inducing flange 332 of the master locking link 33, so that the master locking link 33 rotates in a clockwise direction from the door lock release preparation state where the master locking link 33 is hung on the seating protrusions 231 of the pawl release lever 23 to rotate the pawl release lever 23 in an anticlockwise direction.

The pawl 12 is rotated by the rotation of the pawl release lever 23 together and thus separated from the catch 11, so that the catch 11 can be freely rotated. Thus, the door on the side opposite to the collision is released from the state locked to the vehicle body can be opened.

The master locking link 33 may be provided with a press protrusion 334 which the arm 323 of the control lever 32 is contacted to or closely contacted to.

Figure 10:
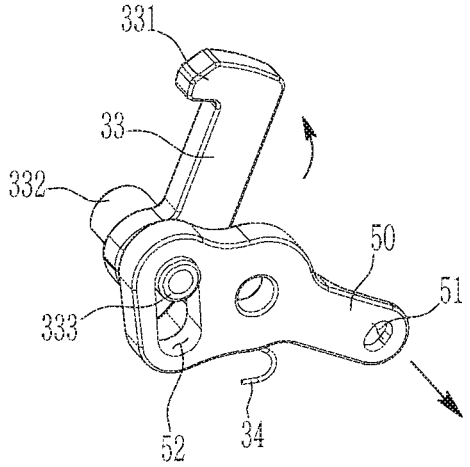
FIG. 10 is an operational explanatory diagram of an outside emergency operating lever and the master locking link of the motor-driven door latch for the vehicle according to an exemplary embodiment of the present invention.

On the other hand, in the door lock release preparation state, if the user pulls the outside handle, as shown in FIG. 10, an outside emergency operating lever 50 connected with the outside handle through a wire is rotated.

The outside emergency operating lever 50 may be installed on the second base plate 2 to be rotatable, one end portion thereof may be formed with a wire hole 51 with which a wire is connected and the other end portion thereof may be formed with a first long hole 52 into which a pin shaft 333 provided at the master locking link 33 is inserted.

When the outside emergency operating lever 50 is rotated, the master locking link 33 is further rotated in a clockwise direction from the door lock release preparation state by the rotation of the outside emergency operating lever 50 to rotate the pawl release lever 23 in an anticlockwise.

The pawl 12 is rotated by the rotation of the pawl release lever 23 together to be separated from the catch 11 to allow the catch 11 to freely rotate, so that the door locked to the vehicle body on the side opposite to the collision is released and the door can be opened.

Figure 11:
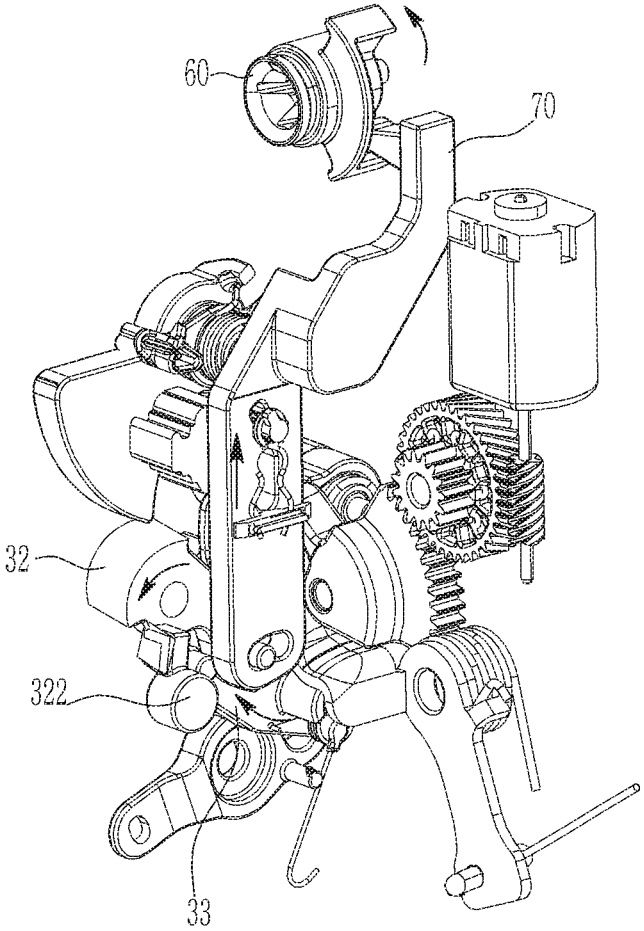
FIG. 11 is an operational explanatory diagram when operating a key for a vehicle of the motor-driven door latch for the vehicle according to an exemplary embodiment of the present invention.

On the other hand, when the battery of the vehicle is discharged and the motor 21 become inoperable, if the user inserts a key for a vehicle a key hole to rotate a key cylinder, as shown in FIG. 11, a key nut 60 provided at the key cylinder is rotated and a key lever 70 is raised by the rotation of the key nut 60 to rotate the second driven gear 32. Thus, the rotation of the second driven gear 32 allows the master locking link 33 to be released from the second driven gear 32. The master locking link 33 is rotated by the elastic restoring force of the pressurizing spring 34 in a clockwise direction, so that the door lock release preparation state where the hook 331 of the master locking link 33 is hung on the seating protrusions 231 of the pawl release lever 23 is achieved.

In the door lock release preparation state, when the user pulls the outside handle, as described above, the outside emergency operating lever 50 is rotated so that the door can be opened.

Figure 12:
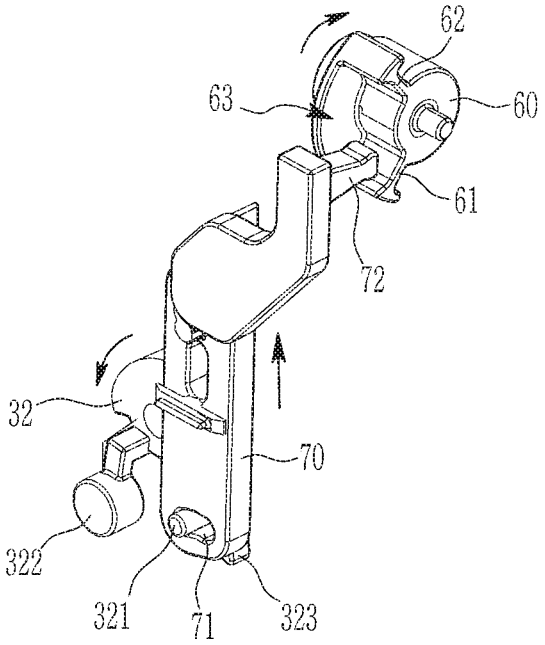
FIG. 12 is an operational explanatory diagram of a key nut and a key lever of the motor-driven door latch for the vehicle according to an exemplary embodiment of the present invention.

Referring to FIG. 12, a second long hole 71 may be formed at a lower portion of the key lever, a coupling protrusion 321 inserted into the second long hole 71 may be provided at the second driven gear 32, a protrusion 72 may be provided on an upper portion of the key lever 70, two operating protrusions 61 and 62 spaced from each other in a circumference direction may be provided at the key nut 6*o* and a movable groove 63 which the protrusion 72 is inserted into and can move therein may be provided between the first and second operating protrusions 61 and 62.

That is, since the control lever 32 is connected with the key lever 70 through the second long 71 and the coupling control protrusion 321, when the control lever 32 is rotated, the key lever 70 moves up and down but the protrusion 72 of the key lever 70 moves up and down in the movable groove 63 of the key nut 60, so that the protrusion 72 of the key lever 70 is not contacted with the first and second operating protrusions 61 and 62 of the key nut 60.

On the other hand, when the key nut 6*o* is rotated by operation of the key for a vehicle, the key lever 70 is contacted with the first operating protrusion 61 to be forcibly raised up, so that the control lever 32 is forcibly rotated by the key lever 70 and the master locking link 33 rotates also, thereby achieving the door lock release preparation state.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

What is claimed is:

1. A motor-driven door latch for a vehicle having a vehicle body and a vehicle door, the motor-driven door latch comprising:

a catch part that is caught on a striker mounted on the vehicle to lock the vehicle door to the vehicle body or is released from the striker so that the vehicle door can be opened from the vehicle body;

a door locking and releasing part that includes a motor and is configured to apply torque to the catch part through the motor to allow the catch part to be locked to or released from the striker; and a collision response part that is configured to apply torque to the catch part through the door locking and releasing part in order to, in the event of a collision, keep the vehicle door in the collision in a locked state and allow a vehicle door on a side opposite to the collision to be opened, wherein the collision response part comprises:

a master locking link, which is installed to be rotatable and includes a hook at one end portion thereof;

a control lever, which is installed to be rotatable and includes an inertia weight at one end portion thereof and an arm at another end portion thereof, so that the arm is connected at or separated from the master locking link to control the operation of the master locking link; and a pressurizing spring applying an elastic force to the master locking link in order to rotate the master locking link in a direction.

2. The motor-driven door latch of claim 1, further comprising a door latch controller configured to detect an operation of a handle or a button installed at the vehicle door and to apply an operation signal to the motor.

3. The motor-driven door latch of claim 1, further comprising an inside emergency operating lever, which is connected with an inside handle installed at the vehicle door and is configured to receive an operation force of the inside handle to rotate and to apply torque to the catch part through the collision response part and the door locking and releasing part.

4. The motor-driven door latch of claim 3, further comprising an outside emergency operating lever, which is connected with an outside handle installed at the vehicle door and is configured to receive an operation force of the outside handle to rotate and to apply torque to the catch part through the collision response part and the door locking and releasing part.

5. The motor-driven door latch of claim 4, wherein the catch part comprises:

a catch having a locking groove that the striker mounted on the vehicle body is caught in or separated from, the catch being installed to be rotatable; and a pawl installed to be rotatable and either in close contact with the catch to limit rotation of the catch or separated from the catch to allow the catch to be freely rotatable.

6. The motor-driven door latch of claim 5, wherein the door locking and releasing part comprises:

the motor, which can rotate in a clockwise direction and an anticlockwise direction and includes a drive gear;

a driven gear engaged with the drive gear;

a pawl release lever coupled to the pawl to be integrally rotated; and an operating lever, which is engaged with the driven gear and is configured to receive the torque through the driven gear to rotate the pawl release lever.

7. The motor-driven door latch of claim 3, wherein:

the inside emergency operating lever is installed to be rotatable, one end portion of the inside emergency operating lever being provided with a pressurizing flange; and the master locking link is provided with a rotation inducing flange, which corresponds to the pressurizing flange and is pressed by the pressurizing flange down to rotate the master locking link.

8. The motor-driven door latch of claim 4, wherein:

the outside emergency operating lever is installed to be rotatable, one end portion outside emergency operating lever being formed with a wire hole with which a wire is connected and another end portion of the outside emergency operating lever being formed with a first long hole; and the master locking link is provided with a pin shaft inserted into the first long hole.

9. The motor-driven door latch of claim 1, wherein:

a key cylinder into which a key for the vehicle can be inserted, the key cylinder being provided with a key nut;

the key nut is connected with one end portion of a key lever; and an other end portion of the key lever is connected with the control lever.

10. The motor-driven door latch of claim 9, wherein:

the key lever is formed with a second long hole at a lower portion thereof; and the control lever is provided with a coupling protrusion inserted into the second long hole.

11. The motor-driven door latch of claim 6, further comprising:

two seating protrusions formed at the pawl release lever; and a pressurizing protrusion seated on the seating protrusions, the pressurizing protrusion configured to press and rotate the pawl release lever.

12. The motor-driven door latch of claim 5, wherein:

a key cylinder into which a key for the vehicle can be inserted, the key cylinder being provided with a key nut;

the key nut is connected with one end portion of a key lever; and another end portion of the key lever is connected with a control lever.

13. The motor-driven door latch of claim 12, wherein:

the key lever is formed with a second long hole at a lower portion thereof; and the control lever is provided with a coupling protrusion inserted into the second long hole.

14. The motor-driven door latch of claim 13, wherein:

a protrusion is provided at an upper portion of the key lever;

the key nut is provided with first and second operating protrusions spaced from each other in a circumference direction; and a movable groove into which the protrusion is inserted to move is provided between the first and second operating protrusions.

15. A motor-driven door latch for a vehicle having a vehicle body and a vehicle door, the motor-driven door latch comprising:

a catch part that is caught on a striker mounted on the vehicle to lock the vehicle door to the vehicle body or is released from the striker so that the vehicle door can be opened from the vehicle body;

a door locking and releasing part that includes a motor and is configured to apply torque to the catch part through the motor to allow the catch part to be locked to or released from the striker; and a collision response part that is configured to apply torque to the catch part through the door locking and releasing part in order to, in the event of a collision, keep the vehicle door in the collision in a locked state and allow a vehicle door on a side opposite to the collision to be opened;

wherein the catch part comprises:

a catch having a locking groove that the striker mounted on the vehicle body is caught in or separated from, the catch being installed to be rotatable; and a pawl installed to be rotatable and either in close contact with the catch to limit rotation of the catch or separated from the catch to allow the catch to be freely rotatable; and wherein the collision response part comprises:

a master locking link, which is installed to be rotatable and includes a hook at one end portion thereof;

a control lever, which is installed to be rotatable and includes an inertia weight at one end portion thereof and an arm at another end portion thereof, so that the arm is connected at or separated from the master locking link to control the operation of the master locking link; and a pressurizing spring applying an elastic force to the master locking link in order to rotate the master locking link in a direction.

16. The motor-driven door latch of claim 15, wherein the door locking and releasing part comprises:

the motor, which can rotate in a clockwise direction and an anticlockwise direction and includes a drive gear;

a driven gear engaged with the drive gear;

a pawl release lever coupled to the pawl to be integrally rotated; and an operating lever, which is engaged with the driven gear and is configured to receive the torque through the driven gear to rotate the pawl release lever.

17. A motor-driven door latch for a vehicle having a vehicle body and a vehicle door, the motor-driven door latch comprising:

a catch part that is caught on a striker mounted on the vehicle to lock the vehicle door to the vehicle body or is released from the striker so that the vehicle door can be opened from the vehicle body;

a door locking and releasing part that includes a motor and is configured to apply torque to the catch part through the motor to allow the catch part to be locked to or released from the striker;

a collision response part that is configured to apply torque to the catch part through the door locking and releasing part in order to, in the event of a collision, keep the vehicle door in the collision in a locked state and allow a vehicle door on a side opposite to the collision to be opened; and an outside emergency operating lever, which is connected with an outside handle installed at the vehicle door and is configured to receive an operation force of the outside handle to rotate and to apply torque to the catch part through the collision response part and the door locking and releasing part wherein the catch part comprises:

a catch having a locking groove that the striker mounted on the vehicle body is caught in or separated from, the catch being installed to be rotatable; and a pawl installed to be rotatable and either in close contact with the catch to limit rotation of the catch or separated from the catch to allow the catch to be freely rotatable;

wherein the door locking and releasing part comprises:

the motor, which can rotate in a clockwise direction and an anticlockwise direction and includes a drive gear;

a driven gear engaged with the drive gear;

a pawl release lever coupled to the pawl to be integrally rotated; and an operating lever, which is engaged with the driven gear and is configured to receive the torque through the driven gear to rotate the pawl release lever; and wherein the collision response part comprises:

a master locking link, which is installed to be rotatable and includes a hook at one end portion thereof;

a control lever, which is installed to be rotatable and includes an inertia weight at one end portion thereof and an arm at another end portion thereof, so that the arm is connected at or separated from the master locking link to control the operation of the master locking link; and a pressurizing spring applying an elastic force to the master locking link in order to rotate the master locking link in a direction.

18. The motor-driven door latch of claim 17, wherein:

the inside emergency operating lever is installed to be rotatable, one end portion of the inside emergency operating lever being provided with a pressurizing flange; and the master locking link is provided with a rotation inducing flange, which corresponds to the pressurizing flange and is pressed by the pressurizing flange down to rotate the master locking link.

19. The motor-driven door latch of claim 17, wherein:

the outside emergency operating lever is installed to be rotatable, one end portion outside emergency operating lever being formed with a wire hole with which a wire is connected and another end portion of the outside emergency operating lever being formed with a first long hole; and the master locking link is provided with a pin shaft inserted into the first long hole.

20. The motor-driven door latch of claim 17, wherein:

a key cylinder into which a key for the vehicle can be inserted, the key cylinder being provided with a key nut;

the key nut is connected with one end portion of a key lever; and an other end portion of the key lever is connected with the control lever.

* * * * *